US008336320B2

(12) United States Patent
Kim et al.

(10) Patent No.: US 8,336,320 B2
(45) Date of Patent: Dec. 25, 2012

(54) REFRIGERATOR AND DRAWER FOR REFRIGERATOR

(75) Inventors: Eunjeong Kim, Gyeongsangnam-do (KR); Eunyoung Park, Gyeongsangnam-do (KR); Sangho Oh, Gyeongsangnam-do (KR); Jaehyun Soh, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 393 days.

(21) Appl. No.: 12/821,209

(22) Filed: Jun. 23, 2010

(65) Prior Publication Data

US 2011/0146334 A1 Jun. 23, 2011

(30) Foreign Application Priority Data

Dec. 18, 2009 (KR) ..... 10-2009-0127256

(51) Int. Cl.
*F25D 17/06* (2006.01)

(52) U.S. Cl. ..... 62/92; 623/283

(58) Field of Classification Search ..... 62/283, 62/441, 449, 176.1, 92
See application file for complete search history.

(56) References Cited

U.S. PATENT DOCUMENTS 5,540,492 A * 7/1996 Dasher et al. ..... 312/404
6,116,029 A * 9/2000 Krawec ..... 62/3.3
6,691,070 B1 * 2/2004 Williams et al. ..... 702/188
7,325,409 B2 * 2/2008 Espinosa ..... 62/78
7,845,181 B2 * 12/2010 Evans et al. ..... 62/176.1
2003/0217695 A1 * 11/2003 Fukutomi et al. ..... 118/666
2004/0177640 A1 * 9/2004 Rafalovich et al. ..... 62/407
2004/0206108 A1 * 10/2004 Wood ..... 62/441
2005/0120728 A1 * 6/2005 Carter ..... 62/151
2008/0115514 A1 * 5/2008 Steimel ..... 62/176.6
2008/0159907 A1 * 7/2008 Joshi et al. ..... 422/5
2008/0178621 A1 * 7/2008 Kang ..... 62/179
2008/0196427 A1 * 8/2008 Bianchi et al. ..... 62/176.6

FOREIGN PATENT DOCUMENTS

KR 10-0524785 B1 10/2005
KR 10-2007-0020832 A 2/2007
KR 10-0830463 B1 5/2008
KR 10-0844329 B1 7/2008

OTHER PUBLICATIONS

Korean Notice of Allowance dated Dec. 26, 2011 for Application No. 10-2009-0127256, with English Translation, 7 pages.

* cited by examiner

*Primary Examiner* — Mohammad Ali
(74) *Attorney, Agent, or Firm* — Fish & Richardson P.C.

(57) ABSTRACT

Provided are a refrigerator and a drawer for a refrigerator. The drawer for the refrigerator includes a receiving member received in the refrigerator to provide a receiving space for receiving foods, an induction member disposed inside the receiving member to induce a formation of moisture on a surface thereof, an indicating member disposed inside the receiving member, the indicating member comprising an indicating part for indicating a humidity state to the outside, and a transmission part providing a space through which the moisture flows, together with the indicating member.

20 Claims, 9 Drawing Sheets

REFRIGERATOR AND DRAWER FOR REFRIGERATOR

CROSS-REFERENCE TO RELATED APPLICATIONS

The present application claims priority under 35 U.S.C. 119 and 35 U.S.C. 365 to Korean Patent Application No. 10-2009-0127256 (filed on Dec. 18, 2009), which is hereby incorporated by reference in its entirety.

BACKGROUND

The present disclosure relates to a refrigerator and a drawer for the refrigerator.

Generally, a refrigerator is a home appliance, which stores foods in a storage space to keep foods at low temperatures. The refrigerator generates cool air by heat-exchanging with refrigerant that circulates through a cooling cycle. The refrigerator enables the foods to be stored in a fresh state by cooling the inside of the storage space using the cold air.

Due to changes in dietary life and well-being trends, consumers prefer larger, multi-functional refrigerators, and various convenient refrigerators have been introduced in the market.

The foods to be stored in a refrigerator or frozen state may be adequately stored in shelves, drawers and baskets, which are provided inside the refrigerator. The shelves, the drawers, and the baskets may be disposed at various positions within the refrigerator and have various sizes and storage conditions to store the foods.

Foods such as vegetables and fruits should be separately stored from the other foods to maintain the foods in a fresh state for a long time. For this, vegetable room is defined by the drawers and covers separated from the other spaces.

It is necessary that the inside of the vegetable room is maintained at adequate humidity due to characteristics of the foods such as the vegetables and fruits stored in the vegetable room.

SUMMARY

Embodiments provide a refrigerator in which a humidity state therein is visible by a consumer and a drawer for the refrigerator.

In one embodiment, a drawer for a refrigerator includes: a receiving member received in the refrigerator to provide a receiving space for receiving foods; an induction member disposed inside the receiving member to induce a formation of moisture on a surface thereof; an indicating member disposed inside the receiving member, the indicating member including an indicating part for indicating a humidity state to the outside; and a transmission part providing a space through which the moisture flows, together with the indicating member, wherein when the moisture flows between the transmission part and the indicating member, the indicating part is confirmed through the transmission part.

In another embodiment, a refrigerator includes: a cabinet; a barrier partitioning a storage space within the cabinet into a plurality of storage spaces; and a drawer disposed in any one storage space of the plurality of storage spaces, wherein the drawer includes: a receiving member providing a receiving space, the receiving member including a transmission part; and an indicating member in the receiving space, the indicating member including a protruding indicating part, wherein when moisture is formed on the indicating part, the indicating part is exposed to the outside of the receiving member through the transmission part.

In further another embodiment, a refrigerator includes: a cabinet; a barrier partitioning a storage space within the cabinet into a plurality of storage spaces; and a drawer disposed in any one storage space of the plurality of storage spaces, wherein the drawer includes: a receiving member providing a receiving space, the receiving member including a transmission part; and a humidity indicating unit within the receiving member, the humidity indicating unit including an indicating member for indicating a humidity state by a degree of a moisture formation.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. However, the sprit of the present disclosure is not limited to the embodiments, and other embodiments by modifications, additions, and deletions of other element also fall on the sprit of the present disclosure.

While a side by side type refrigerator in which a refrigerator compartment and a freezer compartment are respectively disposed in left and right sides is exemplarily illustrated for the sake of descriptive convenience and ease of understanding, the present disclosure is not limited thereto. For example, the present disclosure may be applicable to all types of refrigerators including a drawer.

Figure 1:
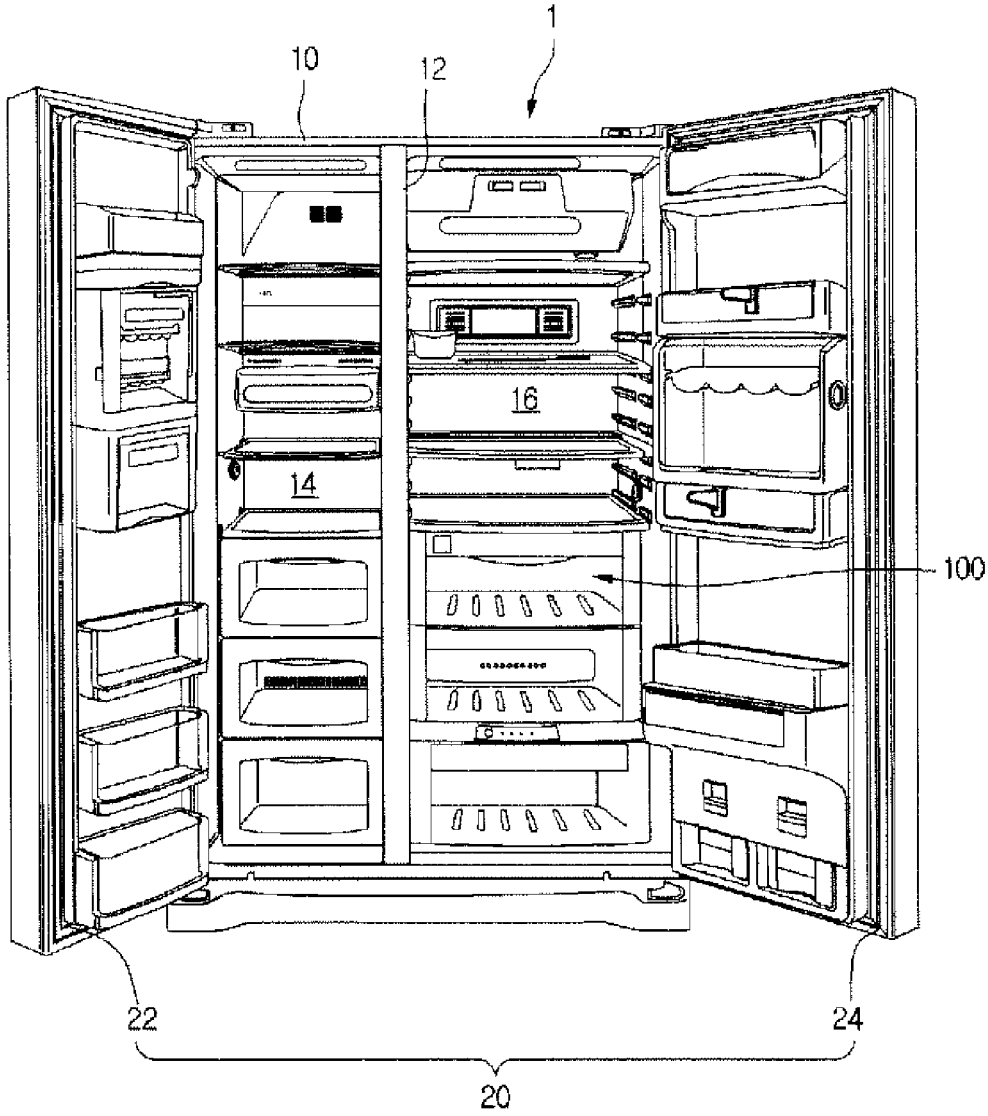
FIG. 1 is a front view of a refrigerator with a door opened according to an embodiment.

FIG. 1 is a front view of a refrigerator with a door opened according to an embodiment.

Referring to FIG. 1, a refrigerator 1 according to an embodiment includes a cabinet 10 in which a storage space is defined therein and a door 20 selectively opening and closing the storage space.

The storage space of the cabinet 10 is partitioned into left and right parts by a barrier 12. A freezer compartment 14 is defined at one side of the barrier 12, and a refrigerator compartment 16 is defined at the other side of the barrier 12. The door 20 is rotatably disposed on the cabinet 10. The door 20 includes a freezer compartment door 22 opening and closing the freezer compartment 14 and a refrigerator compartment door 24 opening and closing the refrigerator compartment 16.

A plurality of shelves, drawers 100, and baskets may be disposed within the cabinet 10. Thus, various foods may be stored in an adequate space and state.

The foods such as vegetables and fruits may be stored in at least one of the plurality of drawers 100. A receiving space within the drawers 100 may be selectively covered by drawing in and out of a receiving member 110 that will be described later. For example, the drawers 100 may be disposed in the freezer compartment 16.

Figure 2:
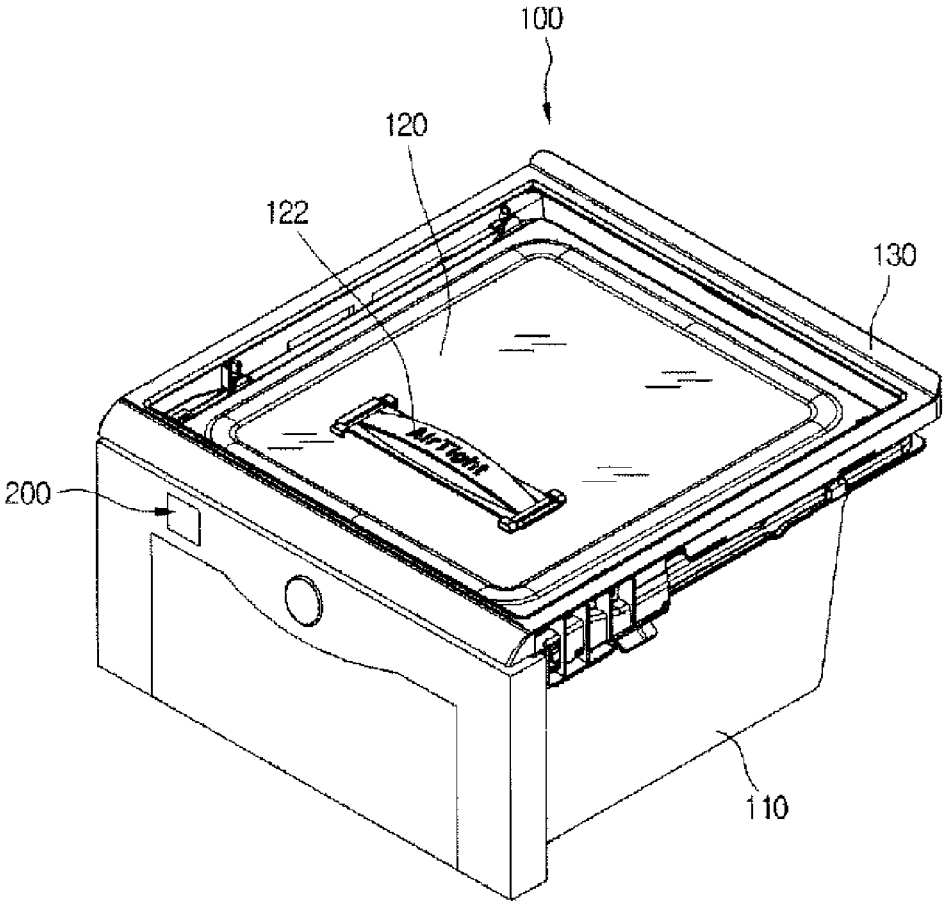
FIG. 2 is a perspective view of a drawer according to an embodiment.
Figure 3:
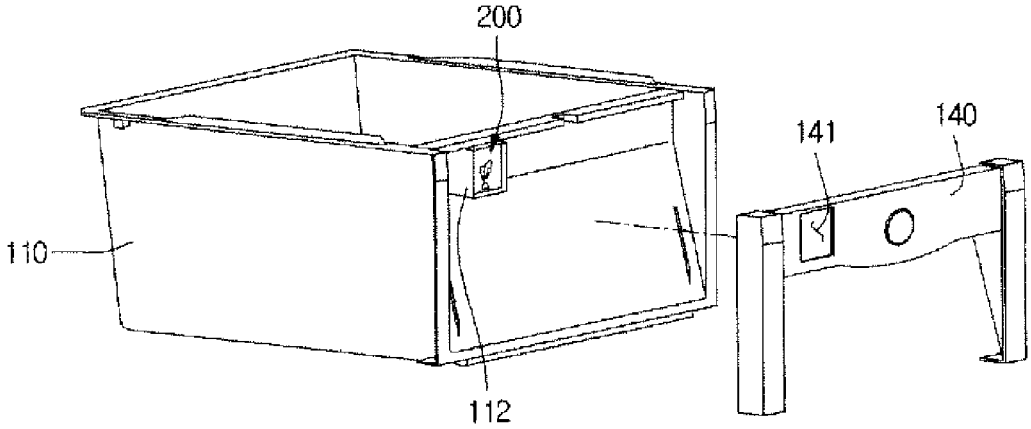
FIG. 3 is a front perspective view of a receiving member according to an embodiment.

FIG. 2 is a perspective view of a drawer according to an embodiment, and FIG. 3 is a front perspective view of a receiving member according to an embodiment.

Referring to FIGS. 2 and 3, the drawer 100 includes the receiving member 110 defining a receiving space, a cover covering the receiving member 110, and a guide member 130 guiding a drawing in and out of the receiving member 110 and a movement of the cover 120.

In detail, the guide member 130 is disposed within the cabinet 10. For example, the guide member 130 may be disposed inside the refrigerator compartment 16. A groove or protrusion on which the guide member 130 is seated may be defined in an inner wall of the refrigerator compartment 16. The guide member 130 may be detachably disposed on the groove or the protrusion.

The receiving member 110 defines a receiving space for receiving foods. For example, an upper side of the receiving member 110 may be opened. The receiving member 110 is seated on the guide member 130. The receiving member 110 may be slidable in front and rear directions in a state where the receiving member 110 is seated on the guide member 130.

The cover 120 may cover the opened upper side of the receiving member 110. A plurality of water collection grooves (not shown) for collecting moisture within the receiving member 110 may be disposed in a bottom surface of the cover 120. When humidity within the receiving member 110 is increased, waterdrops may be formed inside the water collection grooves. Also, the plurality of water collection grooves may be sequentially disposed.

An elastic member 122 may be disposed on the cover 120. The elastic member 122 is disposed between the cover 120 and the guide member 130 to allow the cover 120 to be forcibly faced downward. That is, when the receiving member 110 is drawn in, the cover 120 is closely attached to the receiving member 110 by elasticity of the elastic member 122. Thus, the cover 120 may seal the inside of the receiving member 110.

As necessary, the guide member 130 may not be provided. That is, the cover 120 is disposed inside the refrigerator compartment 16, and the receiving member 110 may be slidably connected to the cover 120.

A mounting part 112 is disposed on a front surface of the receiving member 110. A humidity indicating unit 200 for physically indicating a humidity state within the receiving member 110 is disposed on the mounting part 112. The humidity indicating unit 200 may be inserted into the mounting part 112.

For example, the humidity indicating unit 200 may be disposed on the mounting part 112 disposed inside the receiving member 110. Thus, when viewed from a front side, a front surface of the humidity indicating unit 200 may be viewed from the outside.

That is, an opening may be defined at a side of the receiving member 110 including the humidity indicating unit 200, or the receiving member 110 may have a transparent side. In the present embodiment, the opening or the transparent side defined in the receiving member 110 may be called a transmission part 112*a*.

A separate front cover 140 may be coupled to the front surface of the receiving member 110. An opening 141 may be defined in the front cover 140 at a position corresponding to the mounting part 112. Also, the opening 141 may have a size corresponding to that of the mounting part 112.

Figure 4:
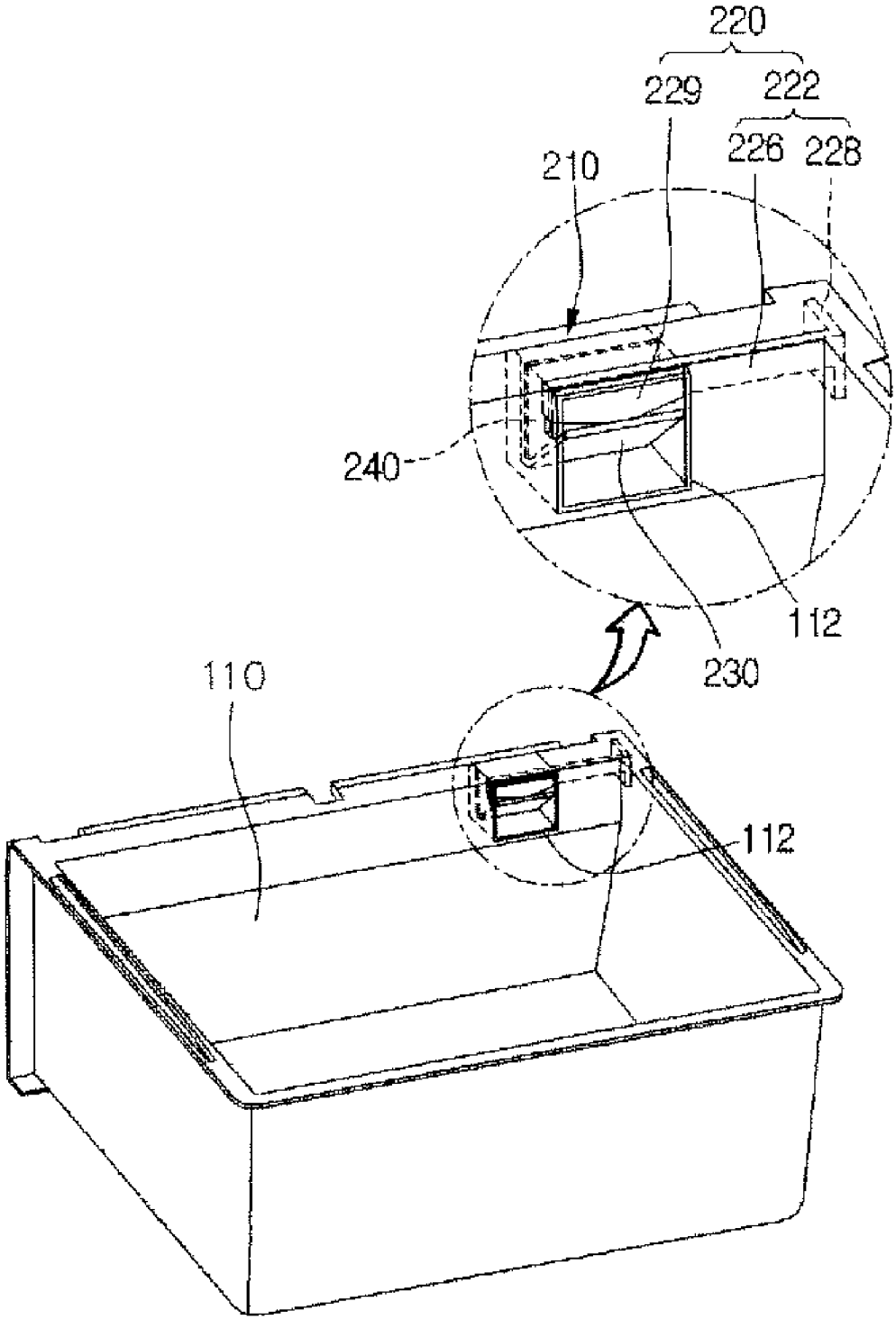
FIG. 4 is a rear perspective view of the receiving member according to an embodiment.
Figure 5:
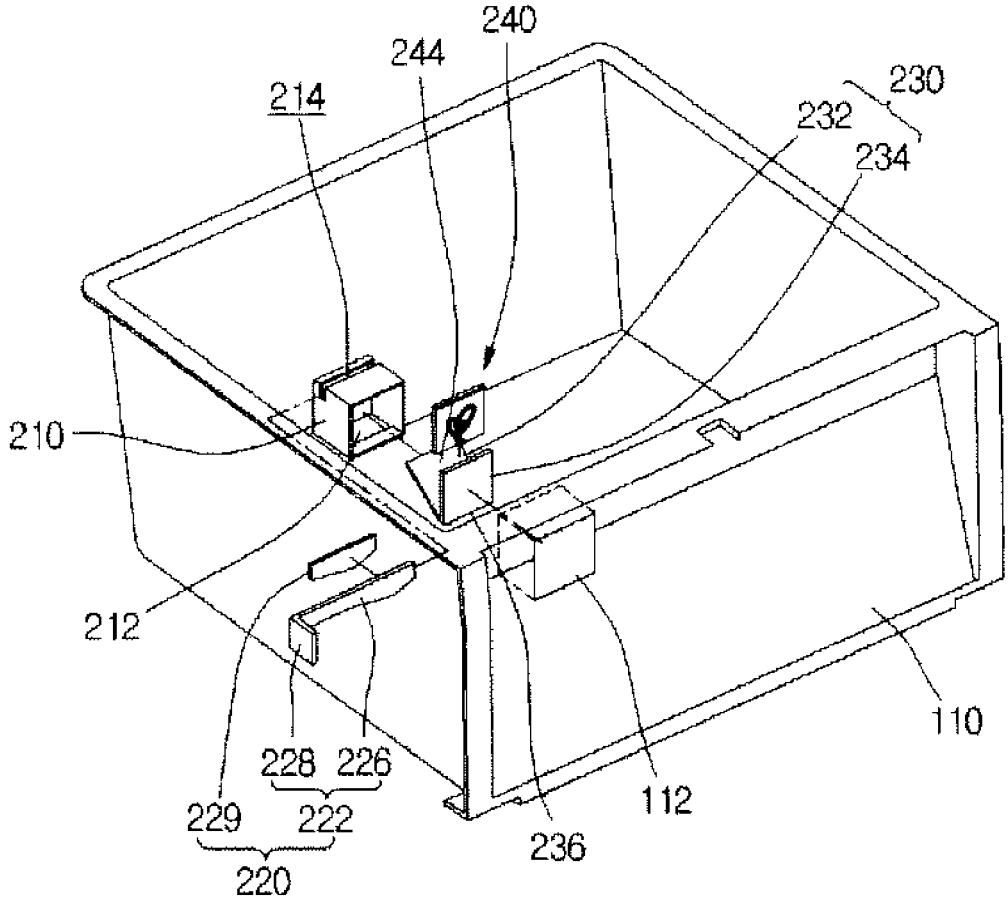
FIG. 5 is an exploded perspective view of an indicating unit according to an embodiment.
Figure 6:
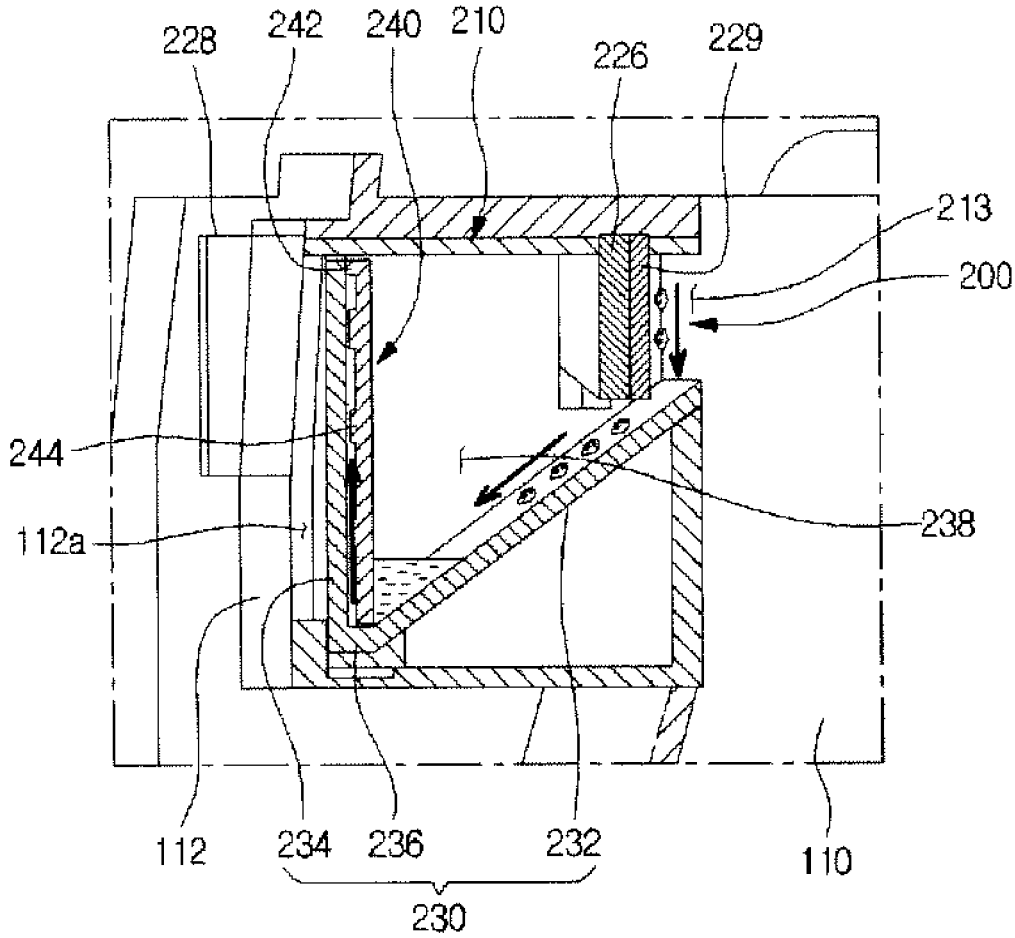
FIG. 6 is a sectional view of the indicating unit according to an embodiment.

FIG. 4 is a rear perspective view of the receiving member according to an embodiment, FIG. 5 is an exploded perspective view of an indicating unit according to an embodiment, and FIG. 6 is a sectional view of the indicating unit according to an embodiment.

Referring to FIGS. 4 to 6, the humidity indicating unit 200 includes a case 210 defining an outer appearance thereof, an induction member 220 inducing the formation of the waterdrops, a water collection member 230 for collecting the waterdrops, and an indicating member through which a water flow occurring due to a capillary action is indicated to the outside.

The case 210 may be inserted into the mounting part 112. The case 210 is configured to fixedly mount the induction member 220, the water collection member 230, and the indicating member 240.

In detail, a front opening 212 is defined in a front surface of the case 210. The water collection member 230 may be inserted through the front opening 212. A rear opening 213 is defined in a rear surface of the case 210. The receiving member 110 may communicate with the case 210 through the rear opening 213.

An upper end of a rear surface of the case 210 supports the water collection member 230. That is, a rear end of the water collection member 230 is inserted into the rear opening 213 and supported by the rear surface of the case 210.

An insertion part 214 in which a portion of the induction member 220 is inserted may be defined in the case 210.

The induction member 220 forms the waterdrops on a surface thereof by dew condensation phenomenon when the humidity within the receiving member is increased. The induction member 220 may include an extension part 222 and a dew condensation part 229.

In detail, the dew condensation part 229 may be disposed on the extension part 222. The extension part 222 conducts heat of a low temperature of the receiving member toward the dew condensation part 229. The extension part 222 may be formed of a metal material such as aluminum having superior thermal conductivity.

The extension part 222 may be disposed at a position having the lowest temperature in the receiving member 110 or extend toward the position having the lowest temperature. The extension part 222 may decrease a temperature of the dew condensation part 229 by the conduction. Thus, the extension part 222 may promote the formation of the waterdrops on the dew condensation part 229.

For this, the extension part 222 extends from the inside of the case 210 up to a sidewall of the receiving member 110 most close to an inner wall of the freezer compartment 14. The extension part 222 includes a first portion 226 extending from the case 210 up to the sidewall of the receiving member 110 and a second portion 228 bent at an end of the first portion 226 to contact the sidewall of the receiving member 110. The second portion 228 may contact the sidewall of the receiving member 110.

Here, the second portion 228 may have a width greater than that of the first portion 226. This is done because the heat is further well conducted at the sidewall of the receiving member 110. A portion of the first portion 226 and the second portion 228 may extend to the outside of the case 210 to contact a side of the receiving member 110.

The extension part 222 may extend to the sidewall of the receiving member 110 adjacent to the freezer compartment 14 as well as extend to a cool air discharge hole of the refrigerator or the other side of the inside of the receiving member 110.

The dew condensation part 229 contacts the extension part 222 disposed inside of the case 210 in the extension part 222. The dew condensation part 229 may be formed a glass material to well form the waterdrops on the surface thereof and allow the formed waterdrops to flow downward.

A central portion of a lower end of the dew condensation part 229 may protrude. This is done for a case in which the waterdrops formed on the dew condensation part 229 flows toward a center while moving downward.

As necessary, the dew condensation part 229 may be formed of a film having a smooth surface, but the glass material. Alternatively, the dew condensation part 229 may be a coated surface on which the extension part 222 is coated.

The water collection member 230 is disposed below the induction member 220. The water collection member 230 collects the water dropping from the dew condensation part 229. Also, the water collection member 230 may contact a portion of the indicating member 240. A gap through which the water flows by the capillary action may be defined between the water collection member 230 and the indicating member 240.

The water collection member 230 may be formed of a glass material to improve the movement of the waterdrops and allow seeing-through of the indicating member 240.

In detail, the water collection member 230 includes a guide part 232 inclinedly extending in a downward direction of the dew condensation part 229 and the transmission part 234 extending upward from a lower end of the guide part 232. Both sides of the water collection member 230 are closed by left and right sides of the case 210 when the water collection member 230 is disposed inside the case 210. Thus, a space 238 in which the moisture is collected by the water collection member 230 and the case 210 may be defined. That is, a bottom surface of the space 238 is defined by the guide part 232 and a connection part 236 that will be described later. Both lateral surfaces of the space 238 are defined by both lateral surfaces of the case 210.

The guide part 232 may be supported by a rear upper end of the case 210. The transmission part 234 is vertically disposed with respect to the bottom surface of the case 210. The transmission part 234 may be horizontally disposed with respect to the opened front surface of the case 210, i.e., the front surface of the mounding part 112.

The connection part 236 may be disposed between the guide part 232 and the transmission part 234. The indicating member 240 is seated on the connection member 236.

As necessary, the connection part 236 may not be provided. Also, the indicating member 240 may be disposed on a portion at which the guide part 232 and the transmission part 234 are connected to each other.

The indicating member 240 may have a rectangular plate shape corresponding to that of the transmission part 234. The moisture collected into the water collection member is formed on the indicating member 240.

The indicating member 240 may be formed of a plastic material. Also, the indicating member may be colored with an opacity color, e.g., a blue color to allow the moisture to be clearly visible.

A contact part 242 is disposed on a circumference of a front surface of the indicating member 240 except a lower end of the indicating member 240. The contact part 242 contacts a back surface of the transmission part 234. The indicating member 240 includes an indicating part 244 for indicating a humidity state. The indicating part 244 protrudes from the indicating member 240. The indicating part 244 does not contact the transmission 234. That is, a protruding length of the indicating part 244 is less than that of the contact part 242. Thus, when the contact part 242 of the indicating member 240 is closely attached to the back surface of the transmission part 234, a gap is defined between the back surface of the transmission part 234 and the indicating part 244.

Thus, the moisture may flow between the indicating member 240 and the transmission part 234 by the gap. When the moisture flows through the gap defined between the indicating part 244 and the transmission part 234, a user may easily confirm the indicating part 244 from the outside.

The indicating part 244 is disposed on the indicating member 240 and has a predetermined pattern to indicate the humidity state within the receiving member 110. Thus, when the water flows between the indicating member 240 and the transmission part 234, the user may confirm a specific pattern of the indicating member 240.

Hereinafter, an operation of a drawer of the refrigerator including the above-described parts according to an embodiment will be described.

Figure 7:
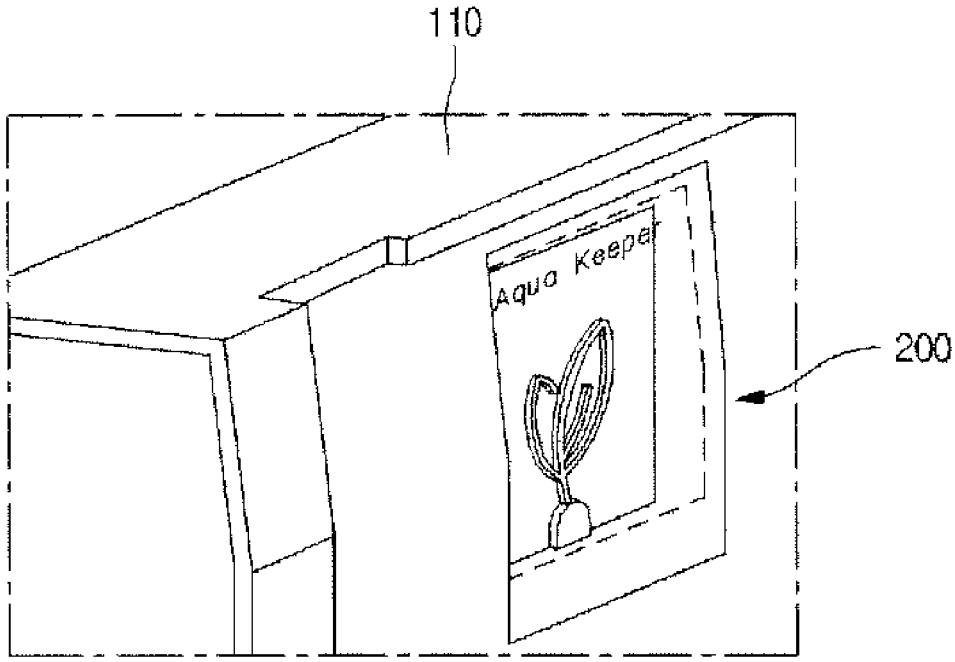
FIG. 7 is a view illustrating a state in which humidity within the receiving member is low according to an embodiment.
Figure 8:
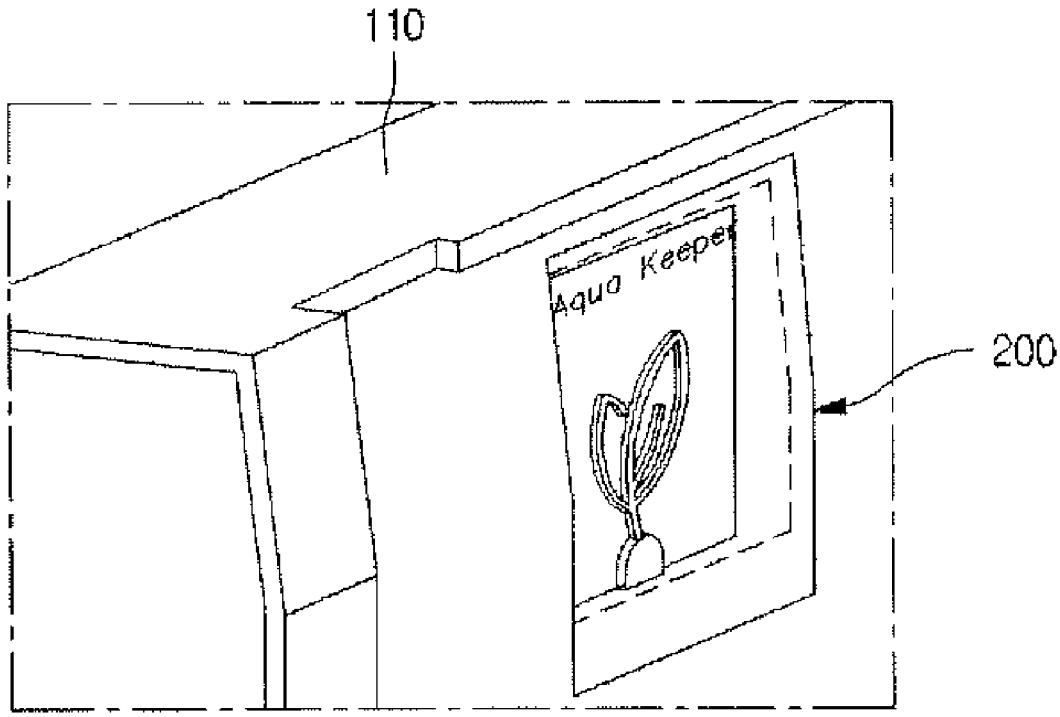
FIG. 8 is a view illustrating a state in which humidity within the receiving member is high according to an embodiment.

FIG. 7 is a view illustrating a state in which humidity within the receiving member is low according to an embodiment, and FIG. 8 is a view illustrating a state in which humidity within the receiving member is high according to an embodiment.

Referring to FIGS. 4 to 8, when the inside of the refrigerator is cooled, the fruits and vegetables to be stored in a low temperature may be stored in the receiving member 110.

When the receiving member 110 has low inner humidity, the waterdrops is not well formed on the dew condensation part 229 of the humidity indicating unit 200. In this state, the moisture is not collected inside the water collection member 230.

Thus, the moisture does not flow along the indicating part 244 of the indicating member 240. As a result, the indicating part 244 is not clearly seen or is not seen at all as shown in FIG. 7 when viewed from the outside of the receiving member 110.

In this state, the user confirms the indicating member 240 exposed through the receiving member 110. As a result, it is seen that the inner humidity of the receiving member 110 is low.

When the inner humidity of the receiving member 110 is high in a state where the foods are received within the receiving member 110, the waterdrops are formed on the dew condensation part 229 of the induction member 220. Here, a later surface of the receiving member 110 contacting the second portion 228 of the induction member 220 is disposed at a portion adjacent to the barrier 12, i.e., a position close to the freezer compartment 14.

Thus, the lateral surface of the receiving member 110 has a relatively low temperature when compared to other potions of the receiving member 110. A low-temperature heat of the lateral surface of the receiving member 110 is converted along the second portion 228 and the first portion 226 of the induction member 220 to decrease a temperature of the dew condensation part 229.

When the temperature of the dew condensation part 229 is decreased, a temperature difference between a surface of the dew condensation part 229 and the inside of the receiving member 110 adjacent to the dew condensation part 229 occurs. The formation of the waterdrops on the dew condensation part 229 is further promoted due to the temperature difference.

An amount of the waterdrops formed on the dew condensation part 229 is increased above a predetermined amount, the waterdrops flow downward toward a central portion of a lower end of the dew condensation part 229. Thus, the waterdrops dropping from the dew condensation part 229 moves along the guide part 232 and is collected inside the water collection member 230.

When a predetermined amount of water is collected into the water collection member 230, the collected water flows to a lower end of the indicating member 240. The collected water flows into the space between the indicating part 244 and the back surface of the transmission part 234 due to the capillary action and moves upward.

Thus, when the indicating member 240 is seen from the outside of the receiving member 100, a configuration of the indicating part 244 is clearly seen.

In particular, when the indicating part 244 has an opacity dark color such as a blue color, the color may become dark due to the moisture. Also, the configuration of the indicating part 244 may be further clearly seen through the front surface of the receiving member 110, e.g., may become a state shown in FIG. 8.

Thus, when the user looks at the outside of the receiving member 110, the indicating part 244 is clearly seen as shown in FIG. 8. Therefore, it may be determined that the inner humidity of the receiving member 110 is high.

When the user determines that the inner humidity of the receiving member 110 is excessive through the humidity indicating unit 200, since there is the danger that the foods within the receiving member 100 go bad, the user may perform an operation for controlling the humidity. Also, the user may perform an operation for decreasing the inner humidity of the receiving member 110 to control the inner humidity of the receiving member 110.

The refrigerator and the drawer for the refrigerator according to an embodiment may be applicable to various embodiments except the above-described embodiment. Hereinafter, a refrigerator and a drawer for the refrigerator according to another embodiment will be described.

Although the water collection member includes the transmission part in the drawer according to an embodiment, the present embodiment is different from the above-described embodiment in that a transmission part of a drawer for a refrigerator according to the present embodiment is a portion of a receiving member.

The refrigerator and the drawer for the refrigerator according to the present embodiment are equal to those of the above-described embodiment except a structure of the transmission. Thus, their detailed descriptions will be omitted. Also, like reference numerals refer to like elements throughout.

Figure 9:
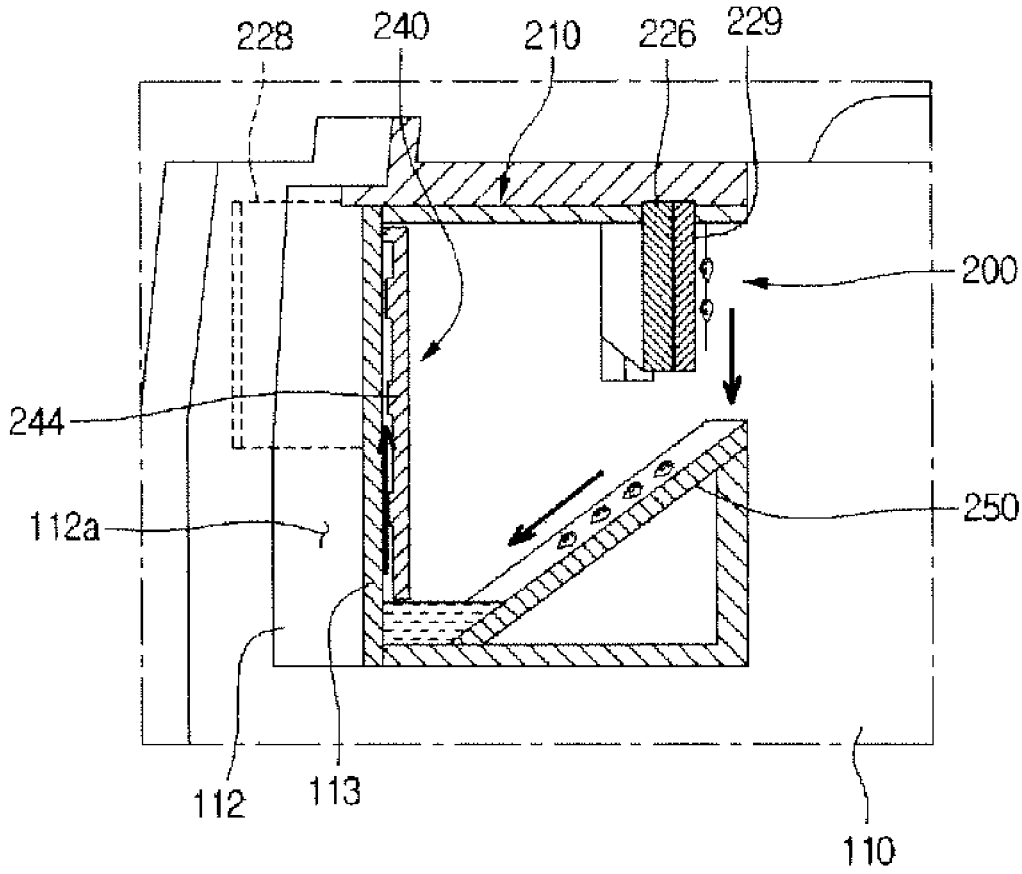
FIG. 9 is a sectional view of an indicating unit according to another embodiment.

FIG. 9 is a sectional view of an indicating unit according to another embodiment.

Referring to FIG. 9, a mounting part 112 is disposed on a front surface of a receiving member 110 according to another embodiment. The mounting part 112 may have a recessed rectangular parallelepiped shape, and thus, a case 210 that will be described later may be inserted into the mounting part 112. An opening may be defined in a front surface of the mounting part 112, or the front surface of the mounting part 112 may be formed of a transparent material. The opening defined in the front surface of the mounting part 112 or the transparent portion may be called a first transmission part 112*a*.

A humidity indicating unit 200 for physically indicating a humidity state within the receiving member 110 is disposed on the mounting part 112.

A second transmission part 113 for generating a capillary action with an indicating member 240 that will be described later is disposed on the mounting part 112. In detail, the second transmission part 113 is disposed between the first transmission part 112*a* and the indicating member 240. The second transmission part 113 may be vertically disposed with respect to a bottom surface of the mounting part 112. The second transmission part 113 may be integrated with the mounting part 112. Alternatively, the second transmission part 113 may be separated from the mounting part 112 as a separate part, and then coupled to the mounting part 112. That is, the second transmission part 112*a* may be a portion of the receiving member 110.

Also, the second transmission part 113 may be formed of a transparent material to allow the inside of the drawer to be viewed through the second transmission part 113.

The humidity indicating unit 200 Includes a case 210 defining an outer appearance thereof, an induction member 220 inducing the formation of waterdrops, an indicating member 240 an indicating member through which a water flow occurring due to the capillary action is indicated to the outside, and a guide part 250 guiding the water induced by the induction member 220 to collect the water into the case 210.

A contact part 242 is disposed on a circumference of a front surface of the indicating member 240 except a lower end of the indicating member 240. The contact part 242 contacts a back surface of the second transmission part 234. The indicating member 240 includes an indicating part 244 for indicating a humidity state. The indicating part 244 protrudes from the indicating member 240. The indicating part 244 does not contact the second transmission 234. That is, a protruding length of the indicating part 244 is less than that of the contact part 242. Thus, when the contact part 242 of the indicating member 240 is closely attached to the back surface of the second transmission part 234, a gap is defined between the back surface of the second transmission part 234 and the indicating part 244.

Thus, the moisture may flow between the indicating member 240 and the second transmission part 234 by the gap. When the moisture flows through the gap defined between the indicating part 244 and the second transmission part 234, a user may easily confirm the indicating part 244 from the outside.

According to the proposed embodiments, when the inner humidity of the receiving member is increased, the waterdrops are formed on a side of the induction member. Then, the waterdrops formed on the induction member may flow toward the protrusion to allow the user to see the protrusion from the outside.

Thus, when the protrusion is exposed to the outside, it is seen that the inner humidity of the receiving member is high.

That is, the user may easily determine the humidity state within the receiving member through the indicating member. Thus, when the inner humidity of the receiving member is high, the user may actively perform the operation for decreasing the inner humidity of the receiving member to improve food storage performance of the receiving member.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drawer for a refrigerator, the drawer comprising:

a receiving member received in the refrigerator to provide a receiving space for receiving foods;

an induction member disposed inside the receiving member to induce a formation of moisture on a surface thereof;

an indicating member disposed inside the receiving member, the indicating member comprising an indicating part for indicating a humidity state to the outside; and a transmission part providing a space through which the moisture flows, together with the indicating member, wherein when the moisture flows between the transmission part and the indicating member, the indicating part is confirmed through the transmission part.

2. The drawer according to claim 1, further comprising:

a mounting part in the receiving member; and a case in the receiving member, the case receiving the indicating member.

3. The drawer according to claim 2, wherein the induction member is inserted into the case, and the induction member extends toward an inner surface of the receiving member in a state where the induction member is mounted on the case.

4. The drawer according to claim 1, wherein the induction member comprises:

a dew condensation part for forming the moisture; and an extension part in which a portion thereof is exposed to the outside of the mounting part, the extension part contacting the dew condensation part.

5. The drawer according to claim 4, wherein the dew condensation part is formed of a glass material or has a coated surface.

6. The drawer according to claim 4, wherein the extension part is formed of an aluminum material.

7. The drawer according to claim 1, further comprising a water collection member in which the moisture dropping from the induction member is collected.

8. The drawer according to claim 7, wherein the water collection member comprises:

a guide part inclinedly disposed below the induction member; and the transmission closely attached to the indicating member, wherein the indicating member supports the water collection member.

9. The drawer according to claim 1, wherein the indicating member further comprises a contact part contacting the transmission part, and the indicating part is spaced from the transmission part in a state where the contact part contacts the transmission part.

10. The drawer according to claim 1, wherein the indicating part protrudes from the indicating member and has a predetermined design or pattern.

11. The drawer according to claim 1, wherein the transmission part is a portion of the receiving member.

12. A refrigerator comprising:

a cabinet;

a barrier partitioning a storage space within the cabinet into a plurality of storage spaces; and a drawer disposed in any one storage space of the plurality of storage spaces, wherein the drawer comprises:

a receiving member providing a receiving space, the receiving member comprising a transmission part; and an indicating member in the receiving space, the indicating member comprising a protruding indicating part, wherein when moisture is formed on the indicating part, the indicating part is exposed to the outside of the receiving member through the transmission part.

13. The refrigerator according to claim 12, wherein the drawer further comprises:

a case for receiving the indicating member; and an induction member in which a portion of thereof is disposed inside the case to induce a formation of the moisture on a surface thereof, wherein waterdrops dropping from the induction member is collected into the case, and the waterdrops collected into the case are formed on the indication part.

14. The refrigerator according to claim 13, wherein the waterdrops collected into the case flows through a space between the transmission part and the indicating part by a capillary action and are formed on the indicating part.

15. The refrigerator according to claim 13, further comprising a water collection member for collecting the waterdrops dropping from the induction member inside the case, wherein a portion of the water collection member is disposed between the indicating part and the transmission part, and the waterdrops collected into the water collection member flows through a space between the indicating part and the transmission part.

16. The refrigerator according to claim 13, wherein the plurality of storage spaces comprises a refrigerator compartment and a freezer compartment, the drawer is received into the refrigerator compartment, and the induction member extends toward the barrier.

17. A refrigerator comprising:

a cabinet;

a barrier partitioning a storage space within the cabinet into a plurality of storage spaces; and a drawer disposed in any one storage space of the plurality of storage spaces, wherein the drawer comprises:

a receiving member providing a receiving space, the receiving member comprising a transmission part; and a humidity indicating unit within the receiving member, the humidity indicating unit comprising an indicating member for indicating a humidity state by a degree of a moisture formation.

18. The refrigerator according to claim 17, wherein the indicating member is disposed at a position corresponding to that of the transmission part.

19. The refrigerator according to claim 18, wherein the indicating member comprises an indicating part protruding toward the transmission part, and the moisture is formed on the indicating part.

20. The refrigerator according to claim 17, further comprising the other transmission part between the transmission part and the indicating member, wherein the other transmission part is spaced from the indicating part, and waterdrops flow between the indicating part and the other transmission part.

* * * * *